United States Patent [19]

Fox et al.

[11] Patent Number: 5,042,803

[45] Date of Patent: Aug. 27, 1991

[54] BILLIARDS UTILIZING SIMILAR AND DISSIMILAR BALLS

[76] Inventors: Cordell J. Fox, 5430 Tennessee Pass Dr., Colorado Springs, Colo. 80917; Michael F. Mihalyo, 30 Stafford Ave., Newington, Conn. 06111

[21] Appl. No.: 276,941

[22] Filed: Nov. 28, 1988

[51] Int. Cl.[5] ..... A63B 43/00

[52] U.S. Cl. ..... 273/59 R; 273/22; 273/59 A

[58] Field of Search ..... 273/128 A, 58 B, 22, 273/59 R, 59 A, 11 R, 11 C, 2, 3 A, 3 B, 3 C, 4 R, 4 A, 4 B, 4 C, 5 R,5 A, 5 B, 5 C, 6, 7, 8, 9, 10, 11 R, 11 C, 12–22

[56] References Cited

U.S. PATENT DOCUMENTS

| | | | |
|---|---|---|---|
| 454,544 | 6/1891 | Goodspeed | 273/58 B |
| 996,458 | 6/1911 | Coleman | 273/58 B |
| 1,346,991 | 7/1920 | Tatum | 273/58 B |
| 1,629,364 | 5/1927 | Scholly | 273/58 B |
| 1,969,128 | 8/1934 | Harrison | 273/58 B |
| 2,665,912 | 1/1954 | Juran | 273/118 A |
| 2,731,266 | 1/1956 | Nelson | 273/58 B |
| 3,208,752 | 9/1965 | Pritchard | 273/118 A |
| 3,406,972 | 10/1968 | Wong | 273/118 A |
| 3,547,439 | 12/1970 | Feddick | 273/59 R |
| 3,743,288 | 7/1973 | Danklefsen | 273/6 |
| 3,865,378 | 2/1975 | McPhail | 273/128 A |
| 4,142,720 | 3/1979 | Davis | 273/59 A |
| 4,396,192 | 10/1981 | Fitzpatrick . | |
| 4,452,450 | 8/1984 | Cayton . | |

FOREIGN PATENT DOCUMENTS

| | | | |
|---|---|---|---|
| 67929 | 2/1892 | Fed. Rep. of Germany | 273/128 A |

*Primary Examiner*—Theatrice Brown

[57] ABSTRACT

The invention reside in a plurality of spherically balanced billiard balls whereby the balls are divided into two equal sets of balls, each set of balls being identical in mass distribution, and each ball of each set has a mass dissimilar from the mass of any other ball of the respective set. Each set of balls further has one ball with a mass equal to the median mass of the respective set. The plurality of balls further has another ball which has a mass equal to the median mass ball of said two sets.

7 Claims, 2 Drawing Sheets

| | |
|---|---|
| LINE OF REFERENCE | ——— - - - - ——— - - - - ——— |
| POSITION BEFORE COLLISION | ○ |
| POSITION AFTER COLLISION | ◌ |
| DIRECTION OF MOTION BEFORE COLLISION | ——— |
| DIRECTION OF MOTION AFTER COLLISION | - - - - - - - |

BILLIARDS UTILIZING SIMILAR AND DISSIMILAR BALLS

FIELD OF INVENTION

This invention relates to the table game of billiards, specifically to an improvement in the standard game in that it will provide more variety and complication and will require more skill and planning of the players.

DESCRIPTION OF PRIOR ART

Heretofore the game of billiards consisted of a standard set of 15 game balls all identical in size and mass, and a 16th ball, the cue ball, usually of the same size and mass as the game balls. We specify the cue ball is usually the same size and mass as the other 15 balls except that in automatic vending-machine type billiard tables the cue ball is slightly larger than the game balls so as to enable the return of the cue ball in the event that it inadvertently falls into one of the game table pockets.

The underlying object of traditional billiards' many variations is to knock the game balls into the pockets of the game table by way of an impact initiated by the cue ball. Variations of the game of billiards to date include such changes as using more or fewer than 15 game balls, changing the initial setup of the balls from the standard triangular pattern to a circular design, and keeping the standard triangle of 15 balls and adding any number of additional balls at various locations around the table. Additionally, there are several variations in which the markings on the balls are altered from the standard numbering of 1 through 15, the first eight being of various solid colors and the remaining seven being striped, to a system whereby the balls are marked so as to simulate playing cards, dice, and baseball to name a few. And finally, there are numerous variations of play in which the ordering scheme that the game balls are hopefully knocked into the game table pockets is altered.

Yet of all these variations one thing remains constant: All game balls are the same in size, mass, and composition so that planning collisions to knock game balls into game table pockets is quite routine and easily mastered.

Most users, therefore, would find it desirable to have a more challenging less mundane modification to this widely played game.

OBJECTS AND ADVANTAGES

Accordingly we claim the following as objects and advantages of our invention: to provide a modification to the game of billiards, specifically a modification to the balls with which it is played, in which any given collision can have several different possible outcomes increasing both the challenge of the game and the planning necessary to play it, while still permitting the play of the numerous variations of billiards already established to be played with our improved set of billiard balls as well as adding several new and challenging variations of our own.

In addition we claim the following additional objects and advantages: to provide a modification to the game of billiards in which players previously outclassed will again find themselves able to compete with those who have mastered traditional billiards in that our modification will be chesslike in both its strategical requirements and complications and its elusion of mastery.

Readers will find further objects and advantages of the invention from a consideration of the ensuing description and the accompanying drawings.

DRAWING FIGURES

DRAWING REFERENCE NUMERALS

Figure 1:
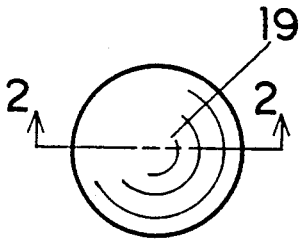
FIG. 1 shows a modification 1 ball perspective view.

19 plastic material
21 void for different density material
22 variable wall thickness
31 low density material
41 high density material
51 offsetting mass
81 high density particular material surrounded by a viscous fluid
83 wall thickness of a modification 3 ball
84 spherical void of a modification 3 ball
90 current art ball #92
91 current art ball #93
100 modification 1 high mass ball #102
101 modification 1 low mass ball #103
120 modification 2 ball #121
150 parallelogram ball rack

DESCRIPTION OF GAME BALLS/OPERATION OF GAME BALLS—MODIFICATION 1

Figure 2:
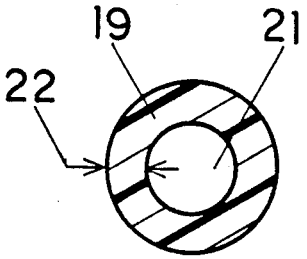
FIG. 2 shows a sectional view of a modification 1 ball taken along line 2—2 of FIG. 1.

FIGS. 1 and 2 show perspective and sectional views respectively of the modification 1 game balls according to the preferred embodiment. Preferably 15 spherically balanced 57 mm diameter balls will comprise the standard modification game ball set and will be divided so as to create two sets of seven balls, each identical in mass distribution, such that the individual balls comprising a set of seven will be of dissimilar mass from one another, and a fifteenth ball whose mass is equal to that of the median mass ball of the two sets.

Figure 3:
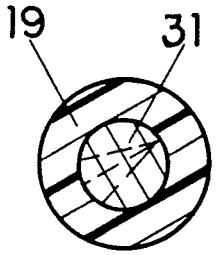
FIG. 3 shows a sectional view of a modification 1 ball taken along line 2—2 of FIG. 1 with a low density material filler.
Figure 4:
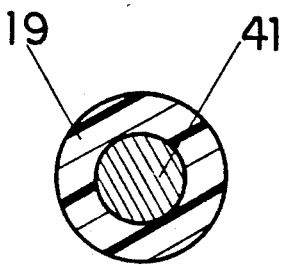
FIG. 4 shows a sectional view of a modification 1 ball taken along line 2—2 of FIG. 1 with a high density material filler.

To accomplish the desired mass variation, the balls might be produced as illustrated in FIGS. 3 and 4 and described as follows: Preferably a ball would be constructed of a high impact plastic material 19 containing no voids and thus establish the median mass. The other balls could then be produced of preferably the same high impact plastic material 19 with spherical voids 21 of varying dimension (see table 1) and filled with a material of low density 31 (such as balsa wood) or a material of high density 41 (such as lead or steel) so as to produce the desired spherically balanced mass variance of the balls.

Preferably the median mass (MM) shall equal approximately 170 grams and the mass variance will be distributed and accomplished as set forth in table 1.

TABLE 1

| Ball Number | Number Produced | Mass Grams | Variable Wall Thickness 22 mm | Void 21 Filler |
|---|---|---|---|---|
| 1 | 2 | 425 | 9.835 | 41 |
| 2 | 2 | 340 | 12.202 | 41 |
| 3 | 2 | 255 | 15.580 | 41 |
| 4 | 3 | 170 (MM) | 28.575 | 19 |
| 5 | 2 | 127 | 10.574 | 31 |
| 6 | 2 | 85 | 5.895 | 31 |
| 7 | 2 | 42 | 2.611 | 31 |

Description of Game Balls/Operation of Game Balls—Modification 2

Figure 5:
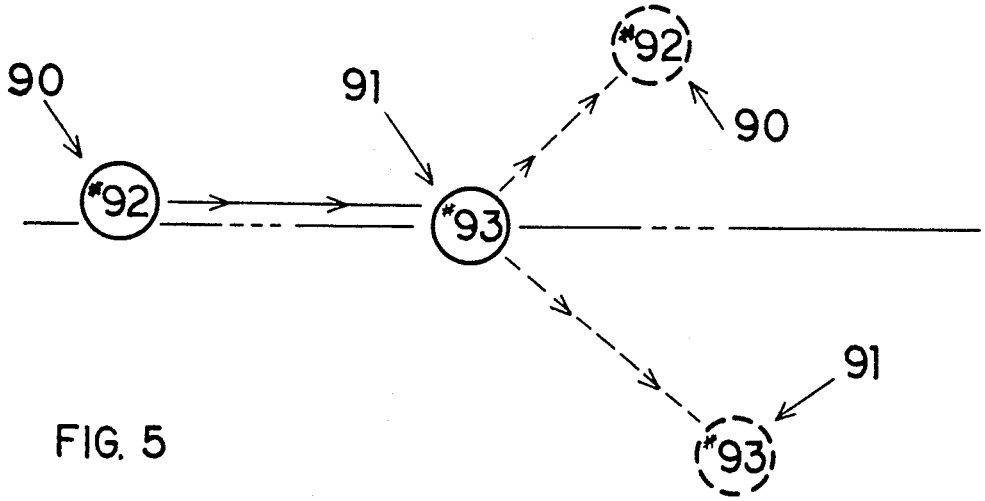
FIG. 5 shows a modification 2 ball perspective view.
Figure 6:
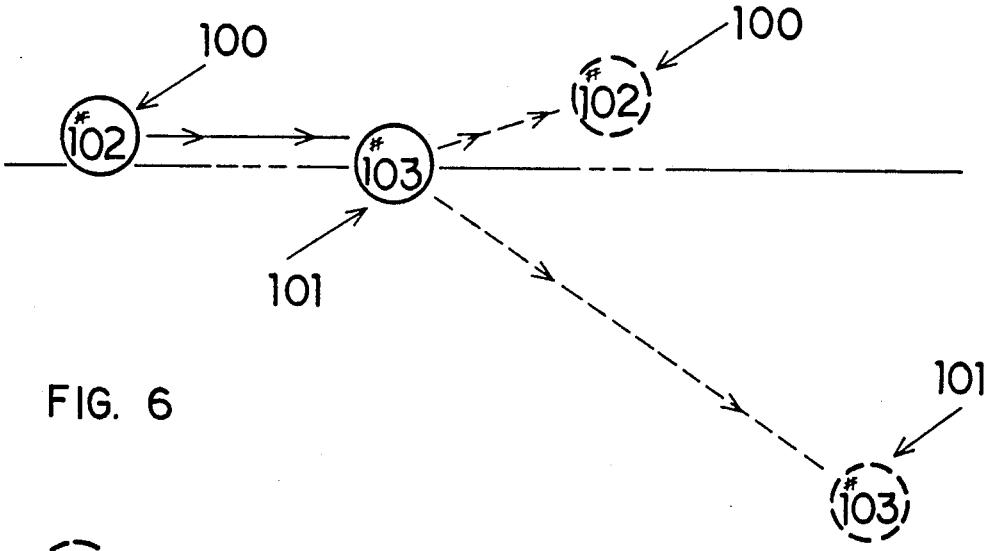
FIG. 6 shows a sectional view of a modification 2 ball taken along line 6—6 of FIG. 5.

FIGS. 5 and 6 illustrate perspective and sectional views respectively of a modification 2 game ball according to the preferred embodiment in which a ball is constructed of the same high impact plastic material 19 as the modification 1 game balls and being the same 57 mm diameter as the modification 1 game balls. Molded within this ball will be a mass 51 preferably cylindrical in shape being ¼ of the median mass of the modification 1 game balls extending from near the center of the ball to its spherical surface so as to create a ball which is spherical yet spherically unbalance.

Description Of Game Balls/Operation Of Game Balls—Modification 3

Figure 7:
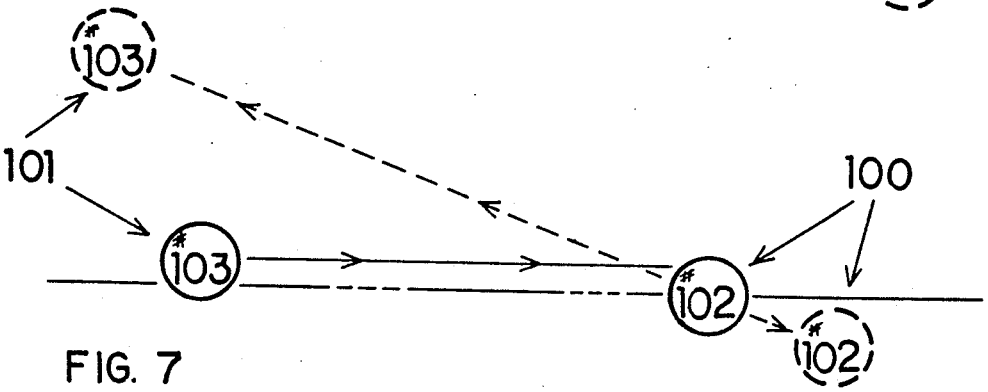
FIG. 7 shows a modification 3 ball perspective view.

FIG. 7 illustrate a perspective view of a modification 3 game ball according to the preferred embodiment in which a ball is constructed of preferably the same high impact plastic material 19 as that used in the production of the modification 1 and 2 game balls and being the same 57 mm outside diameter as the modification 1 and 2 game balls. The modification 3 game ball will be constructed so as to be a spherically balanced hollow sphere, the wall thickness 83 being approximately 12.7 mm, whose hollow center will contain a dampening mechanism. The preferred dampening mechanism shown in FIG. 8 consists of a high density particular material (such as steel or lead shot of approximately 42.5 grams) surrounded by a viscous fluid 81 (such as oil of approximately 29.5 ml).

In use the modification 3 game balls will prefer to remain at rest as a result of the dampening system—it will be difficult to move. When a modification 3 game ball is used to initiate an impact, it will either stop or be dramatically slowed dependent both upon its velocity at the time of impact and the mass of the ball which is struck. Upon striking the table side, the modification 3 game ball will either stop, as in the case of an impact perpendicular to the table side, or be dramatically slowed and move along the table side as in the case of an impact which is not perpendicular to the table side. When a modification 3 game ball is the receiver of an impact from either a cue ball or a modification 1 game ball, its resultant initial vector will be directionally comparable to an impact of a modification 1 game ball incident upon a median mass modification 1 game ball. Its deceleration, however, will be much greater.

Description Of Alternate Cue Balls/Operation Of Alternate Cue Balls

FIGS. 3, 4, and 6, illustrate sectional views of the different variations of alternate cue balls which correspond to modification 1, 2, and 3 game balls according to the preferred embodiment. Preferably all alternate cue balls will be constructed identically to their corresponding modification game balls differing only in color so as to discriminate between them and their modification 1, 2, and 3 counterparts.

Alternate 1 cue balls, FIGS. 3 and 4, are constructed in the same manner as modification 1 game balls being spherically balanced and of varying masses. Preferably only two alternate 1 cue balls will be constructed in this manner as follows: One will be a lighter cue ball equal in mass to modification 1 game ball number 6 (see table 1). The other will be a heavier cue ball equal in mass to modification 1 game ball number 2 (see table 1). A standard cue ball would be constructed entirely of high impact plastic material 19 and would be equal in mass to game ball number 4—the median mass (see table 1).

In play, the lighter alternate 1 cue ball would find it quite difficult to move any game balls heavier than the median mass of the modification 1 game balls making play more difficult. Conversely, the heavier alternate 1 cue ball could quite easily move any of our modification 1, 2, or 3 gameballs.

Alternate 2 cue ball, FIG. 6, is constructed in the same manner as a modification 2 game ball. Preferably only one alternate 2 cue ball will be constructed in this manner.

Play with this cue ball would be challenging even to those who have mastered the current art game of billiards as it will be rare that a cue ball constructed in this manner would follow a straight path to strike an intended ball. An advantage, however, would be the possibility of directing a shot around an obstructing opponents ball although this would require a great degree of skill and an even greater degree of luck.

Alternate 3 cue ball, is constructed in the same manner as a modification 3 game ball. Preferably only one alternate 3 cue ball will be constructed in this manner.

In play this cue ball will tend to stop at or near the point of impact upon striking another ball. Also, banking shots possible with a standard cue ball, such as banking off the side to strike another ball, will not be possible with the alternate 3 cue ball as it will simply stop or cling the table side upon striking the same. An advantage to this cue ball is its unlikeliness to be deflected into a game table pocket as frequently occurs with standard cue balls.

While the above description contains many specifics, the reader should not construe these limitations on the scope of the invention, but merely as exemplifications of the preferred embodiments thereof. Those skilled in the art will envision many other possible variations are within the scope of this invention.

For example skilled artisians will readily be able to change the dimensions and shapes of the various embodiments. They will also be able to make the balls and their weighting 41/lightening 31 masses of alternative materials, possibly eliminating the lightening 31 masses altogether and simply leaving the lighter balls hollow. They can make the balls in their entirety of materials of varying density and thus eliminate the need for internal weighting 41/lightening 31 masses altogether though this may require a common surface material to standardize the balls apparent hardness. They can expand or reduce the range of the mass variation (table 1). They can make the offsetting mass 51 of the modification 2 ball in any shape. They can design the modification 2 ball with a mass 51 which does not extend from the ball's surface to its center, but rather could be designed to reside either nearer to the ball's surface or nearer its center the former making the effects of the offset greater and the latter reducing the effects. Further, they can make the offsetting mass 51 of the modification 2 ball to follow a chord line through the ball and thus still unbalance the ball while making it more stable and predictable than in our preferred embodiment. They can make a modification 2 ball with a low mass offset, or even an offsetting void thus reducing the overall mass of the ball. They can also use a combination of the possible variations stated above to create a spherically unbalanced ball. They can change the overall mass of the modification 3 ball and/or its dampening system. They can make the high density particular material 81 of any high density material, the particles of any size, and will find that it does not necessarily even need to be particular in that a free moving solid mass will suffice They can surround the high density material, in any form, with fluids 81 other than oil, with low density particular solids such as graphite, or even leave out the surrounding medium altogether. They can alter the dampening system entirely using such options as two fluids, one heavier than the other, which may or may not resist mixing such as a 90 weight oil co-located with water. They can enclose the high density material or fluid within a casing of some sort either rigid or not. In fact, they can even combine the ideas of a modification 1 ball with that of a modification 2 ball, or a modification 2 ball with that of a modification 3 ball, either as each is described in the preceeding sections or as above with novel and unusual results. The parallelogram rack, they will find, can be made of alternative materials such as wood or aluminum. They will find that the dimensions and angles can be changed and still the rack will hold 16 balls—a square rack is one such alternative.

Accordingly, the reader is requested to determine the scope of the invention by the appended claims and their legal equivalents and not by the examples which have been given.

we claim:

1. A set of billiard balls for playing a game of table billards comprising: a plurality of balls, said plurality of balls being divided into a first set of balls, a second set of balls and another ball, the number of balls in said second set being equal to the number of balls in said first set, each ball of said first set being spherically balanced and having a mass dissimilar from the mass of any other ball of said first set, and each ball of said second set being spherically balanced and having a mass dissimilar from the mass of any other ball of said second set; the mass distribution of said first and second sets being identical, said first and second sets each having a ball with a mass equal to the media mass of the respective set, and said another ball of said plurality of balls having a mass equal to the median mass ball of said first and second sets.

2. The set of billiard balls as defined in claim 5 wherein, said median mass ball of said first and second sets is solid and constructed from a high impact plastic material.

3. The set of billiard balls as defined in claim 6 wherein, the mass of each ball of said plurality of balls is selected from the mass range of 42 to 425 grams the median mass of each set is approximately 170 grams.

4. The set of billiard balls as defined in claim 5, wherein each ball, except said median mass ball, of said first and sets has a central core of material having a density different from the remaining material of the ball.

5. The set of billiard balls as defined in claim 8, wherein said central core is lead and said remaining material is a high impact plastic.

6. The set of billiard balls as defined in claim 8, wherein said each ball of said first and second sets has central core of balsa wood and said remaining material is a high impact plastic.

7. The set of billiard balls of claim 5 wherein all of the balls of said plurality of balls have the same diameter.

* * * * *

UNITED STATES PATENT AND TRADEMARK OFFICE

CERTIFICATE OF CORRECTION

PATENT NO. : 5,042,803

DATED : August 27, 1991

INVENTOR(S) : Cordell J. Fox & Michael F. Mihalyo

It is certified that error appears in the above-indentified patent and that said Letters Patent is hereby corrected as shown below:

Col. 2, lines 40 & 41, change '/OPERATION--MODIFICATION 1' to --/OPERATION OF GAME BALLS--.

Col. 2, line 44, change 'of the modification 1 game' to --of the game--.

Col. 2, line 47, change 'dard modification game' to --dard game--.

Col. 3, lines 12-68, delete 'Description of--in color'.

Col. 4, lines 1-44, change 'so as--cue balls.' to --Figure 5 illustrates a collision of current art game balls as set forth in the diagram. Figures 6 and 7 illustrate an identical collision of our game balls and depict the variation of results dependent upon which balls are involved in the collision as well as which ball initiates the collision. In current art billiards, there is one possible outcome of a collision given the incident ball's velocity vector. With our game balls, the same collision, given the same incident ball's velocity vector, has 49 different possible outcomes; this is the basis of our invention.--.

UNITED STATES PATENT AND TRADEMARK OFFICE

CERTIFICATE OF CORRECTION

PATENT NO. : 5,042,803

DATED : Aug 27, 1991

INVENTOR(S) : Cordell J. Fox & Michael F. Mihalyo

It is certified that error appears in the above-indentified patent and that said Letters Patent is hereby corrected as shown below:

Col. 4, lines 62-68, delete 'They can--the offset'.
Col. 5, lines 1-33, delete all.
Col. 6, line 1, change '1. A--billiard balls' to --5. A set of balls--.
Col. 6, line 17, change '2. The set of billiard balls' to --6. The set of balls--.
Col. 6, line 21, change '3. The set of billiard balls' to --7. The set of balls--.
Col. 6, line 25, change '4. The set of billiard balls' to --8. The set of balls--.
Col. 6, line 29, change '5. The set of billiard balls' to --9. The set of balls--.
Col. 6, line 32, change '6. The set of billiard balls' to --10. The set of balls--.
Col. 6, line 36, change '7. The set of billiard balls' to --11. The set of balls--.

Signed and Sealed this

Fifteenth Day of October, 1996

*Attest:*

Bruce Lehman

BRUCE LEHMAN

*Attesting Officer*

*Commissioner of Patents and Trademarks*